US005270283A

United States Patent [19]

Koshizuka et al.

[11] Patent Number: 5,270,283

[45] Date of Patent: Dec. 14, 1993

[54] IMAGE RECEIVING SHEET FOR HEAT TRANSFER RECORDING

[75] Inventors: Kunihiro Koshizuka; Atsushi Nakajima, both of Hino, Japan

[73] Assignee: Konica Corporation, Japan

[21] Appl. No.: 756,500

[22] Filed: Sep. 9, 1991

[51] Int. Cl.[5] ..... B41M 5/035; B41M 5/38

[52] U.S. Cl. ..... 503/227; 428/195; 428/413; 428/500; 428/913; 428/914

[58] Field of Search ..... 8/471; 428/195, 413, 428/500, 913, 914; 503/227

[56] References Cited

U.S. PATENT DOCUMENTS 4,840,870 6/1989 Iwagaki et al. ..... 430/201

FOREIGN PATENT DOCUMENTS 191645 8/1986 European Pat. Off. ..... 503/227

2580232 10/1986 France ..... 503/227

OTHER PUBLICATIONS

Patent Abstracts of Japan, vol. 9, No. 264(M-423)(1987); Oct. 22, 1985 JPA-60-110494; Jun. 15, 1985.

Patent Abstracts of Japan, vol. 11, No. 14 (M-553)(2461); Jan 14, 1987 JPA-61-189,986; Aug. 23, 1986.

*Primary Examiner*—B. Hamilton Hess

*Attorney, Agent, or Firm*—Jordan B. Bierman

[57] ABSTRACT

An image receiving sheet comprising an image receiving layer. The image receiving layer contains a copolymer layer containing a vinyl chloride-type resin which has an epoxy group in the molecule. It is used to record images by heat-transferring a thermal diffusible dye contained in an ink layer of an ink sheet for heat transfer recording.

15 Claims, No Drawings

IMAGE RECEIVING SHEET FOR HEAT TRANSFER RECORDING

The present invention relates to an image receiving sheet for heat transfer recording. More particularly, this invention relates to an image receiving sheet for heat transfer recording which is used to record images by heat-transferring a thermal diffusible dye contained in an ink layer of an ink sheet for heat transfer recording.

In recent years, color recording techniques base on the ink jet method, electrophotography and heat transfer method are studied as methods to obtain color hard copies.

Among them, the heat transfer method has advantages of being easy in handling and maintenance, allowing use of a smaller equipment and being cost-saving.

This heat transfer method falls into two types: a method to melt-transfer a meltable ink layer to an image-receiving sheet by heating imagewise a transfer sheet having the meltable ink layer on a support with a laser or thermal head, and a thermal diffusion transfer method (sublimation transfer method) to transfer diffusively a thermal diffusible dye alone to an image-receiving sheet using a transfer sheet having on a support an ink layer containing a heat diffusible dye (for example, sublimation dye).

In the thermal diffusion transfer method, the gradation of images can be controlled by changing the transferring amount of a thermal diffusible dye according to the change in heat energy of a thermal head.

Therefore, the thermal diffusion transfer method has come to attract attention recently as a method which provides color images having a continuous shade change through overlap-recording of cyan, magenta and yellow.

A typical example of image receiving sheet for heat transfer recording used in the above heat transfer recording methods is a laminated sheet in which a polyester resin layer is formed on a support.

In this image receiving sheet for heat transfer recording, the polyester layer functions as an image receiving layer, and a thermal diffusible dye is transferred thereto.

The thermal diffusion transfer method, though attracting an increasing attention, has a problem in providing images with a high quality and high preservability imagewise and rapidly according to electrical signals. And material technologies to solve the problem are still on the way to development.

And the image receiving sheet for heat transfer recording which uses the above polyester image receiving layer requires a high temperature to provide necessary images, and moreover has a problem in image preservability.

This problem has been pointed out not only for polyesters but also for other conventional resins used in image receiving layers.

In other words, it is difficult to obtain images of high densities at a low energy; or even if high density images are obtained at a low energy, there are liable to cause (a) image discoloration and color fading or yellowing of heat-transfer-recording image receiving sheets themselves, and (b) dye bleeding or image blurring by being subjected to light and heat in storing; accordingly, beautiful images with a high sharpness cannot be maintained for long.

On the contrary, conventional heat-transfer-recording image receiving sheets have a disadvantage of causing fusion between the image receiving layer and an ink layer of an ink sheet for heat transfer recording at the time of heat transfer.

The present inventors reported previously that vinyl chloride-type resins were preferred as a resin for the image receiving layer in solving the problem stated above (Japanese Pat. O.P.I. Pub. No. 24996/1985).

After that, use of vinyl chloride-type resins in the image receiving layer was further reported. For example, Japanese Pat. O.P.I. Pub. No. 283595/1986 describes that the combination of a vinyl chloride-vinyl acetate copolymer and a polyester is useful as a resin for the image receiving layer.

SUMMARY OF THE INVENTION

The object of the invention to provide a heat-transfer-recording image receiving sheet capable of forming images of high densities at a low thermal energy, free from fusion with a heat-transfer-recording ink sheet at the time of heat transfer, and excellent in image preservability.

The image receiving sheet of the present invention comprises an image receiving layer containing a vinyl chloride-type resin having an epoxy group in the molecule.

DETAILED DESCRIPTION OF THE INVENTION

[I] Image Receiving Sheet for Heat Transfer Recording

The image receiving sheet for heat transfer recording can be composed of a base material and an image receiving layer formed thereon. If necessary, the image receiving sheet for heat transfer recording may be composed of a self-supporting image receiving layer. Such an image receiving sheet, composed of a self-supporting image receiving layer, allows reduction in number of parts because it uses no base material.

Image receiving layer

In general, the image receiving layer is composed of a binder for image receiving layer and various additives. When necessary, the image receiving layer may be composed of a binder alone.

(1) Binders for image receiving layer

In the invention, it is essential to use, as a binder for image receiving layer, a vinyl chloride-type resin containing an epoxy group in the molecule.

Further, it is preferred in the invention to use a vinyl chloride-type resin containing, besides the epoxy group, a functional group in the molecule as described below:

1 A vinyl chloride-type resin containing an epoxy group, a sulfonic group and/or a carboxyl group in the molecule.
2. A vinyl chloride-type resin containing an epoxy group and a hydroxyl group in the molecule.
3. A vinyl chloride-type resin containing an epoxy group, a sulfonic group and/or a carboxyl group and a hydroxyl group in the molecule.

Among the vinyl chloride-type resins containing these groups, a vinyl chloride-type copolymer represented by the following Formula [I] is particularly preferred.

In Formula [I] showing a vinyl chloride-type copolymer in brackets, blocks consisting of repetitive units enclosed in parentheses may be either in a specific order or in an arbitrary order.

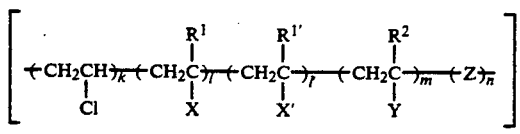

[I]

In the formula, $R^1$, $R^{1'}$ and $R^2$ independently are a hydrogen atom or a lower alkyl group (for example, methyl or ethyl group). $R^1$, $R^{1'}$ and $R^2$ may be the same or different in blocks of respective repetitive units.

X is —A—$SO_3M$; X' is —A'—COOM; and Y is

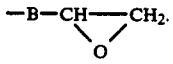

M is a hydrogen atom or an alkali metal atom such as Li, Na, K.

In Formula [I], k represents an integer of 200 to 800, 1 and 1' each represent an integer of 0 to 100 (provided that 1 and 1' are not zero concurrently), m an integer of 1 to 100, and n an integer of 0 to 200.

A, A' and B are independently an interlining group to join a —$SO_3M$, —COOM or epoxy group with the principal chain of the vinyl chloride-type copolymer.

Examples of the interlining group are those illustrated below.

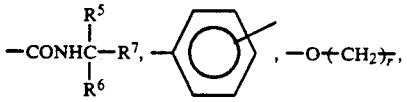

$-COO(CH_2)_r$, —CONH—, $(CH_2)_r$ or $-CONH(CH_2)_r$, where $R^5$ and $R^6$ independently are a hydrogen atom, or an alkyl or phenyl group each having 1 to 15 carbon atoms; $R^7$ is an alkylene group having 1 to 15 carbon atoms; and r is an integer of 0 to 20.

Z is a repetitive unit incorporated, according to specific requirements, to improve characteristics of the vinyl chloride-type copolymer; namely, adjustment of solubility in solvents, flexibility, compatibility with other resins, curability and cross-linking capability, prevention of fusion, and improvement in image preservability.

Examples of such repetitive units Z include those shown below.

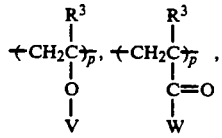

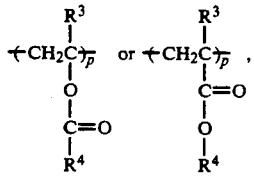

where $R^3$ is a hydrogen atom or a lower alyl group (for example, methyl or ethyl group); V is a hydrogen atom or $-(CH_2)_q-OH$, or $(CH_2CH_2O)_q-H$; W is —OM (M is a hydrogen or alkali metal atom), $-(OCH_2CH_2)_q-OH$, $-(OCH_2)_q-OH$ (q=1 to 4); p is an integer of 1 to 50; and $R^4$ is an unsubstituted hydrocarbon having 1 to 20 carbon atoms, for example, methyl, ethyl, octyl or hexadecyl.

As other examples of $-(Z)_n-$, there may be used any of the copolymerizable constituent units such as vinylidene chloride, ethylene, styrene, maleic anhydride, maleic acid and maleates.

The polymerization degree (Pn) of a vinyl chloride-type copolymer of the invention represented by Formula [I] is usually 250 or more and 500 or less. It is preferable that at least one —$SO_3M$ or —COOM be contained in said vinyl chloride-type copolymer, that the content of the repetitive unit having —$SO_3M$ or —COOM be 0 to 3 wt. %, that the content of the repetitive unit having an epoxy group be 0.5 to 9 wt. %, and that the content of vinyl chloride be 95 to 80 wt. %.

When a vinyl chloride-type resin of the invention is used in an image receiving layer, too small a vinyl chloride content tends to cause fusion between the image receiving layer and an ink layer of an ink sheet for heat transfer recording, and an excessive amount of vinyl chloride is liable to lower the solubility to solvents.

The repetitive unit containing an epoxy group increases the amount of a diffusible dye transferred, forming a transferred image of high density.

Usable vinyl chloride-type resins according to the invention are commercially available. Examples thereof include MR-110 and MR-120, both of which are produced by Nippon Zeon.

These vinyl chloride-type resins can be synthesized by known methods.

For example, the vinyl chloride-type resin used in the invention can be synthesized by introducing, through reaction, a hydrophilic group or a functional group such as —$SO_3M$ or —COOM to a copolymer containing neither —$SO_3M$ nor —COOM in Formula [I], for instance, a hydroxy-group-containing vinyl chloride-type resin such as vinyl chloride-vinyl alcohol copolymer.

In order to avoid separation of by-products and opening of epoxy rings, the above copolymer may also be synthesized by reacting a prescribed amount of a reactive monomer having an unsaturated linkage to from the repetitive unit shown in Formula [I] in a reaction vessel such as autoclave, in the presence of conventional polymerization initiators such as radical polymerization initiators including BPO, AIBN, redox polymerization initiators, anionic polymerization initiators, and cationic polymerization initiators.

In the invention, the vinyl chloride-type resin represented by the above vinyl chloride-type copolymer may be used singly or in combination with other resins.

When the vinyl chloride-type resin is combined with other resins, it is preferable that the amount of the resin be more than 10% by weight of the total resin.

The term other resins used here means a polyvinyl chloride resin, vinyl chloride-type copolymer resin being a copolymer of vinyl chloride and another monomer other than the vinyl chloride-type resin of the invention (for example, vinyl chloride-vinyl acetate copolymer), polyester resin, acrylic resin, polyvinylpyrrolidone, polycarbonate, cellulose triacetate, styrene-acrylate resin, vinyltoluene-acrylate resin, polyurethane resin, polyamide resin, urea resin, polycaprolactone resin, styrene-maleic anhydride resin and polyacrylonitrile resin.

Among them, the preferred are a vinyl chloride-type copolymer resin and polyester resin.

These resins may be synthesized for captive use, or may be procured on the market.

Usable commercially available polyester resins include, for example, Vylon 200, Vylon 290, Vylon 600 (products of Toyobo.), KA-1038C (product of Arakawa Chemical) and TP220, TP235 (products of Nippon Synthetichemical).

The above vinyl chloride-vinyl acetate copolymer resin has a vinyl chloride content of preferably 50 to 100 wt. % and a polymerization degree of preferably 50 to 2,500.

The vinyl chloride-vinyl acetate copolymer resin is not necessarily composed only of a vinyl chloride component and a vinyl acetate component, it may contain a vinyl alcohol component or a maleic acid component within the limits not impairing the object of the invention.

Examples of such vinyl chloride-vinyl acetate copolymer resins are S-lec A, S-lec C, S-lec M (products of Sekisui Chemical), vinyl chloride copolymers VACH, vinyl chloride copolymers VYHH, vinyl chloride copolymers VMCH, vinyl chloride copolymers VYHD, vinyl chloride copolymers VYLF, vinyl chloride copolymers VYNS, vinyl chloride copolymers VMCC, vinyl chloride copolymers VMCA, vinyl chloride copolymers VACD, vinyl chloride copolymers VERR, vinyl chloride copolymers VROH (products of Union Carbide) and Denka Vinyl 1000GKT, Denka Vinyl 1000L, Denka Vinyl 1000CK, Denka Vinyl 1000A, Denka Vinyl 1000LK2, Denka Vinyl 1000AS, Denka Vinyl 1000MT2, Denka Vinyl 1000CSK, Denka Vinyl 1000CS, Denka Vinyl 1000GK, Denka Vinyl 1000GSK, Denka Vinyl 1000GS, Denka Vinyl 1000LT3, Denka Vinyl 1000D, Denka Vinyl 1000W (products of Denki Kagaku Kogyo).

From the viewpoint of physical properties, it is preferable that the Tg of other resins used in the image receiving layer be within a range from −20° to 150° C. and especially from 40° to 120° C.

The molecular weight of a binder for the image receiving layer is preferably 2,000 to 100,000.

If the foregoing resins have activated reaction sites, they may be cross-linked or cured by means of radioactive rays, heat, moisture, or catalysts through the utilization of such activated reaction sites, or by giving the resins activated reaction sites if they have no activated reaction sites.

In such a case, there may be used radioactive monomers such as epoxy compounds or acrylic compounds, or cross-linking agents such as isocyanates.

(2) Additives

The image receiving layer may use a releasing agent, antioxidant, UV absorbent, light-stabilizer, filler (inorganic particles, organic resin particles) or pigment. A plasticizer may also be used as a sensitizing agent.

The releasing agent enhances the releasing property between a heat-transfer-recording ink sheet and a heat-transfer-recording image receiving sheet.

As such releasing agents, there can be used a silicone oil (including one called silicone resin); solid wax such as polyethylene wax, amide wax, Teflon wax, or surfactant of fluorine-type or phosphate-type. Of them, a silicone oil is preferred.

The silicone oil falls into two groups, namely the simple addition type to be simply added and the curing type to be cured through reaction.

In the simple addition type, a modified silicone oil is preferably used for its better compatibility with a binder.

Useful modified silicone oils are a polyester-modified silicone resin (or silicone-modified polyester), acryl-modified silicone resin (or silicone-modified acrylic resin), urethane-modified silicone resin (or silicone-modified urethane resin), cellulose-modified silicone resin (or silicone-modified cellulose resin), alkyd-modified silicone resin (or silicone-modified alkyd resin) and epoxy-modified silicone resin (or silicone modified epoxy resin).

That is to say, there can be favorably used a polyester-modified silicone resin containing a polysiloxane resin in the principal chain and formed by copolymerizing a polyester blockwise; polyester-modified silicone resin having as a side chain a dimethylpolysiloxane moiety directly linked to the polyester principal chain; or modified silicone oil or resin formed by block copolymerization, alternative copolymerization, graft copolymerization or random copolymerization between a dimethylpolysiloxane and a polyester.

In the invention, use of a polyester-modified silicone resin is particularly preferred.

Typical examples of the polyester-modified silicone resin include, for example, a block copolymer between a polyester obtained by copolymerization of a diol and a dibasic acid or ring-opening copolymerization of caprolactone and a dimethylpolysiloxane (including a copolymer in which both ends or one end of the dimethylpolysiloxane is blocked with the polyester, and one in which the polyester is blocked with the polysiloxane), and copolymer in which a polyester being the principal chain is linked to dimethylpolysiloxanes being the side chains.

The addition amount of these simple addition-type silicone resins varies depending upon resin types and cannot be determined indiscriminately. But it is usually in a range from 0.5 to 50% and preferably from 1 to 20% by weight of a binder for image receiving layer.

As the curing type silicone oil, there are employed those of reaction-curing type, light-curing type and catalyst-curing type.

The reaction-curing type silicone oil includes one which cures through reaction between an amino-modified silicone oil and an epoxy-modified silicone oil.

Examples of the catalyst-curing type and light-curing type silicone oils include KS-705F-PS, KS-705F-PS-1, KS-770-PL-3 (catalyst-curing type silicone oils made by Shin-Etsu Chemical) and KS-720, KS-774-PL-3 (light-curing silicone oils made by Shin-Etsu Chemical).

The addition amount of these curing type silicone oils is preferably 0.5 to 30% by weight of a binder for image receiving layer.

The releasing layer may also be formed by coating the above releasing agent in the form of solution or dispersion in a suitable solvent on a portion of the image receiving layer's surface and then drying it.

Useful examples of the foregoing antioxidants are those described in Japanese Pat. O.P.I. Pub. Nos. 182785/1984, 130735/1985 and 127387/1989, in addition to conventional compounds used for improving image durability of photographs or other image recording materials.

Examples of the foregoing UV absorbent and light-stabilizer are include those compounds which are described in Japanese Pat. O.P.I. Pub. Nos. 158287/1984, 74686/1988, 145089/1988, 196292/1984, 229594/1987, 122595/1988, 283595/1986 and 204788/1989, besides conventional compounds used for improving image durability of photographs or other image recording materials.

As the foregoing filler, inorganic fine particles or organic resin particles are used.

Examples of the inorganic fine particles are silica gel, calcium carbonate, titanium oxide, acid clay, activated clay and alumina; examples of the organic fine particles include resin particles such as fluororesin particles, guanamine resin particles, acrylic resin particles and silicone resin particles. The addition amount of these inorganic or organic resin particles varies depending upon their specific gravities, but is preferably 0.1 to 70 wt. %.

Typical examples of the foregoing pigment are titanium white, calcium carbonate, zinc oxide, barium sulfate, silica, talc, clay, kaolin, activated clay and acid clay.

As the above plasticizer, there are used phthalates (for example, dimethyl phthalate, dibutyl phthalate, dioctyl phthalate, didecyl phthalate), adipates (for example, dioctyl adipate, methyl lauryl adipate, di-2-ethylhexyl adipate, ethyl lauryl adipate), oleates, succinates, maleates, sebacates, citrates, epoxy stearic acid, epoxides, and further, phosphates such as triphenyl phosphate, tricresyl phosphate, and glycol esters such as ethyl phthalyl ethyl glycolate, butyl phthalyl butyl glycolate.

In the invention, the addition amount of the whole additives is usually in a range from 0.1 to 50% by weight of a binder for image receiving layer.

Base materials

Base materials usable in the invention are, for example, paper, coated paper, synthetic paper (a composite material prepared by laminating a polypropylene or polystyrene film with paper or a plastic film), white polyethylene terephthalate base film, transparent polyethylene terephthalate base film, and polyolefine-coated paper.

The thickness of a base material is generally 20 to 300 μm, preferably 30 to 300 μm.

[II] Preparation of Image Receiving Layer for Heat Transfer Recording

Image receiving sheets for heat transfer recording can be manufactured by the coating method which comprises steps of preparing a coating solution for image receiving layer by dissolving or dispersing, in a solvent, components to form an image receiving layer, applying the coating solution for image receiving layer to the surface of a base material, and then drying it.

Further, image receiving sheets may also be manufactured by the laminating method, which comprises melt-extrusion of a mixture of components to form an image receiving layer on the base material's surface.

In the above coating method, there may be used conventional solvents such as water, alcohols, methyl ethyl ketone, toluene, dioxane and cyclohexanone.

When the above laminating method is employed, the co-extrusion method may also be applicable.

The image receiving layer may be formed over the whole surface of a base material or on a portion of a base material.

The thickness of the image receiving layer formed on a base material is generally 2 to 50 μm and preferably about 3 to 20 μm.

In case an image receiving layer is self-supporting and constitutes said image receiving layer by itself, the thickness of the image receiving layer is 60 to 200 μm, preferably about 90 to 150 μm.

In the heat-transfer-recording image receiving sheet of the invention, a releasing layer containing a releasing material (the above silicone resin, modified silicone resin, silicone film, or cured material thereof) may be laminated on the surface of the image receiving layer, in order to prevent the fusion with an ink layer of heat-transfer-recording ink sheet.

The thickness of this releasing layer is usually 0.03 to 2.0 μm.

In addition, the heat-transfer-recording image receiving sheet of the invention may have a cushion layer between the base material and the image receiving layer.

When the cushion layer is provided, it reduces noise and helps transfer recording of images corresponding to image information with a high reproducibility.

Materials which constitute a cushion layer are, for example, a urethane resin, acrylic resin, ethylene-type resin, butadiene rubber and epoxy resin.

The thickness of the cushion layer is usually 1 to 50 μm, preferably 3 to 30 μm.

[III] Ink Sheet for Heat Transfer Recording

The ink sheet for heat transfer recording is composed of a support and an ink layer formed thereon.

Ink layer

The ink layer contains a thermal diffusible dye and a binder as basic materials.

(1) Thermal diffusible dye

Usable thermal diffusible dyes are cyan dyes, magenta dyes and yellow dyes.

Examples of the cyan dye are those naphthoquinone-type dyes, anthraquinone-type dyes and azomethine-type dyes which are described in Japanese Pat. O.P.I. Pub. Nos. 78896/1984, 227948/1984, 24966/1985, 53563/1985, 130735/1985, 131292/1985, 239289/1985, 19396/1986, 22993/1986, 31292/1986, 31467/1986, 35994/1986, 49893/1986, 148269/1986, 191191/1987, 91288/1988, 91287/1988 and 290793/1988.

Examples of the magenta dye are those anthraquinone-type dyes, azo dyes and azomethine dyes which are described in Japanese Pat. O.P.I. Pub. Nos. 78896/1984, 30392/1985, 30394/1985, 253595/1985, 262190/1896, 5992/1988, 205288/1988, 159/1989 and 63194/1989.

Examples of the yellow dyes are those methine-type dyes, azo-type dyes, quinophthalone-type dyes and anthraisothiazole-type dyes which are described in Japanese Pat. O.P.I. Pub. Nos. 78896/1984, 27594/1985, 31560/1985, 53565/1985, 12394/1986 and 122594/1988.

Particularly preferred thermal diffusible dyes are azomethine dyes prepared by coupling a compound having an open-chained or close-chained active methylene group with an oxidation product of a p-phenylenediamine derivative or an oxidation product of a p-aminophenol derivative, and indoaniline dyes prepared by coupling a phenol or naphthol derivative with an oxidation product of a p-phenylenediamine derivative or an oxidation product of a p-aminophenol derivative.

When an image to be formed is of monochrome, the thermal diffusible dye contained in the ink layer may be any of a yellow dye, magenta dye and cyan dye.

According to the color tone of the image to be formed, there may be contained two or more of the above three types of dyes, or other thermal diffusible dyes.

The amount of the thermal diffusible dye to be used is usually 0.1 to 20 g and preferably 0.2 to 5 g per square meter of support.

(2) Binder

Usable binders are, for example, a cellulose-type resin such as ethyl cellulose, hydroxyethyl cellulose, ethylhydroxyethyl cellulose, hydroxypropyl cellulose, methyl cellulose, cellulose acetate or cellulose acetobutyrate; vinyl-type resin such as polyvinyl alcohols; polyvinyl formal, polyvinyl butyral, polyvinylpyrrolidone; polyester; polyvinyl acetate, polyacrylamide, polyvinylacetacetal, styrene resin, styrene copolymer resin, polyacrylate, polyacrylic acid; rubber-type resin; olefine-type resin; and polyester.

Among these resins, polyvinyl butyral, polyvinyl acetacetal and cellulose-type resin are preferred for their high preservability.

These binders may be used singly or in combination of two or more types.

The weight ratio of the binder to the thermal diffusible dye is preferably 1:10 to 10:1 and especially 2:8 to 8:2.

(3) Other optional components

Further, the foregoing ink layer may contain various additives within the limits not impairing the object of the invention.

Such additives include a silicone resin; silicone oil (including curing type); silicone-modified resin, fluororesin; surfactant; releasing compound such as wax; filler such as silica gel, metal oxide, carbon black or resin fine particles; and curing agent capable of reacting with binder components (for example, radioactive-ray-activated compounds including isocyanates and acrylics).

In addition, meltable compounds such as waxes and higher fatty esters described in Japanese Pat. O.P.I. Pub. No. 106997/1984 may also be used as an additive to facilitates image transfer.

SUPPORT

As a support in the invention, there may be used any of those which have a high dimensional stability and stand the heat applied by a thermal head while recording. But preferable examples thereof are tissue papers such as condenser paper, glassine paper; and films of heat resistant plastics such as polyethylene terephthalate, polyethylene naphthalate, polyamide, polyimide, polycarbonate, polysulfone, polyvinylalcohol, cellophane and polystyrene.

The thickness of a support is preferably 2 to 10 μm, and there may be provided a subbing layer on a support in order to enhance the adhesion between the support and a binder and prevent a dye from transferring or migrating to the support side.

Moreover, an antisticking layer may be formed on the reverse side of a support (in reverse of an ink layer) for preventing the support from fusing with a thermal head, sticking or creasing.

Such an antisticking layer usually has a thickness of 0.1 to 1 μm.

The shape of the support is not particularly limited. There may be employed, for example, sheets or films with large widths and strips or cards with small widths.

[IV] Manufacture of ink sheet for heat transfer recording

The ink sheet for heat transfer recording can be manufactured by steps of dispersing or dissolving the above-mentioned ink layer components in a solvent to prepare an ink-layer-forming coating solution, coating the solution obtained on the surface of a support, and drying the coated layer.

The foregoing binder is dissolved or dispersed into a latex, singly or in combination of two or more, in a solvent before use.

As such a solvent, there can be used water, alcohols (for example, ethanol, propanol), cellosolves (for example, methylcellosolve, ethylcellosolve), aromatics (for example, toluene, xylene, chlorobenzene), ketones (for example, acetone, methyl ethyl ketone), esters (for example, ethyl acetate, butyl acetate), ethers (for example, tetrahydrofuran, dioxane) and chlorinated solvents (for example, chloroform, trichloroethylene).

The above coating solution may be applied by conventional coating methods such as the sequential coating with a gravure roll, extrusion coating, wire bar coating and roll coating.

The ink layer may be formed over the whole surface of a support or on a portion of a support, as a layer containing a monochromatic thermal diffusible dye, or in a layer configuration in which a yellow ink layer containing a binder and a yellow dye, a magenta ink layer containing a binder and a magenta dye, and a cyan ink layer containing a binder and a cyan dye are provided in a specific order.

Further, a black ink layer containing a black image forming substance may be provided between the above three ink layers. This black ink layer may be a diffusion transfer type or a melt transfer type, either of which is useful to provide sharp images.

The thickness of the ink layer prepared as above is generally, 0.2 to 10 μm and preferably 0.3 to 3 μm.

For the sake of convenience when used, the heat-transfer-recording ink sheet of the invention may be perforated or provided with a detector mark to detect a position from which a color changes to a different one.

Further, the layer configuration of the ink sheet for heat transfer recording is not limited to a structure having a support and a heat sensitive layer provided thereon; another layer may be formed on the ink layer.

For example, an overcoat layer may be provided in order to prevent the fusion between the ink layer and an image receiving sheet for heat transfer recording and the set-off of a thermal diffusible dye (blocking).

[V] Image Formation (Heat Transfer Recording)

In forming an image, the ink layer of a heat-transfer-recording ink sheet is superposed on the image receiving layer of a heat-transfer-recording image receiving sheet, and then heat energy is applied imagewise to the interface between the ink layer and image receiving layer. Thereby, the thermal diffusible dye sublimates by an amount corresponding to the heat energy supplied, then moves to the image receiving layer side and is received thereby. As a result, an image is formed on the image receiving layer.

In the invention, the image receiving layer of a heat-transfer-recording image receiving sheet contains an epoxy-group-carrying vinyl chloride-type resin; accordingly, no high energy is required to obtain a necessary image density. In other words, even a lower energy can provide a high density image.

The heat-transfer-recording image receiving sheet of the invention is immune from problems caused by light and heat during storing, such as the image's color-fading, discoloration, blur, and the dye's bleeding as well as yellowing of the sheet itself. Moreover, it is prevented from fusing with a heat-transfer-recording ink sheet in the course of heat transfer recording.

In general, a thermal head is used as a heat source to apply heat energy. But other conventional means such as laser beams, infrared flashes and thermal pens can also be employed.

When a thermal head is used as a heat source, the heat energy given to the thermal head can be changed continuously or by stages, by modulating the voltage or pulse width to be applied to the thermal head.

When laser beams are used as a heat source to impart heat energy, the heat energy to be given can be changed by altering the quantity of light or irradiation area.

In this case, a laser beam absorbing material (in case of semiconductor laser, for example, carbon black or an infrared ray absorbing substance) may be contained in the ink layer or its vicinity in order to facilitates the absorption of laser beams.

Use of a dot generator having a built-in acoustic optical element allows to impart heat energy correspondingly to the size of dots.

When laser beams are used, it is preferable that a heat-transfer-recording ink sheet and a heat-transfer-recording image receiving sheet be contacted closely with each other.

When an infrared flash lamp is used as a heat source, it is preferable that heating be made via a colored layer (such as black) similarly to the case using laser beams.

Heating may also be made via a pattern of an image shaded continuously or a pattern of dots, or may be carried out in combination of a colored layer like an overall black layer and a negative pattern corresponding to a negative of the above pattern.

The heat energy may be applied from the ink sheet side or the image receiving layer side, or from both sides. For an effective heat energy utilization, however, heating from the ink sheet side is preferred.

Through the heat transfer recording as described above, a monochromatic image is formed on the image receiving layer of a heat-transfer-recording image receiving sheet. Further, a color image like a color photograph can be obtained by hybridizing necessary colors in the following manners.

In one method, heat-transfer-recording ink sheets of yellow, magenta, cyan, and black when necessary, are subjected in sequence to heat transfer processes corresponding to respective colors; as a result, a color-photograph-like color image of hybridized color is obtained.

In another method, there is employed a heat transfer-recording ink sheet which has zones formed beforehand by being coated in respective colors, instead of the above heat-transfer-recording ink sheets of respective colors.

In this method, a yellow image is first heat-transferred with the yellow zone, a magenta image is then heat-transferred with the magenta zone, and the same procedure is repeated for cyan. If necessary, this procedure is further repeated for black.

This method is also capable of providing a color-photograph-like color image, and moreover it has an advantage that exchange of heat-transfer-recording ink sheets is not required.

EXAMPLES

The present invention is hereunder described in more detail with the examples and comparative examples. In the description below, "part" means "part by weight".

EXAMPLE 1

A coating solution of the following composition to form a heat-sensitive layer was coated on a corona-treated 6 μm thick polyethylene terephthalate film (product of Toray), by the wire bar coating method so as to give a dry thickness of 1 μm. After drying, a back-side treatment was made by letting fall a few drops of silicone oil (X-41-4003A made by Shin-Etsu Silicone) with a syringe on the back side which was not corona-treated, and allowing the drops to spread all over the surface, so that an ink sheet for heat transfer recording was obtained.

| Coating solution to form the heat-sensitive layer | |
|---|---|
| Disperse dye (Kayaset Blue 136 made by Nippon Kayaku) | 4 parts |
| Polyvinyl butyral (BX-1 made by Sekisui Chemical, polymerization degree: 1700) | 5 parts |
| Methyl ethyl ketone | 90 parts |
| cyclohexanone | 5 parts |

Next, a coating solution of the following composition to form an image receiving layer was coated on a 150-μm thick synthetic paper base (Yupo FPG-150 made by Oji Yuka Synthetic Paper) by the wire bar coating method. After predrying the coated base on a dryer, it was dried for 1 hour at 100 in an oven. Thus, there was obtained a heat-transfer-recording image receiving sheet having a 5-μm thick image receiving layer formed on the synthetic paper.

| Coating solution to form the image receiving layer | |
|---|---|
| Vinyl chloride-type copolymer (MR-110 made by Nippon Zeon) | 10 parts |
| Polyester-modified silicone oil (X-24-8310 made by Shin-Etsu Silicone) | 0.25 part |
| Methyl ethyl ketone | 80 parts |
| Cyclohexanone | 20 parts |

Subsequently, the above ink sheet for heat transfer recording was superposed on the above image receiving sheet for heat transfer recording, so as to have the ink layer's surface of the former contact with the image receiving layer's surface of the latter. Then, image recording was conducted by heating the ink sheet from its support side under conditions of output: 0.4 W/dot, pulse width: 0.3 to 10 msec, and dot density: 6 dots/mm.

After the image recording, each sample was evaluated for the fusion between the ink sheet and image receiving sheet, transferred density on the image receiving layer of the image receiving sheet, heat resistance and light fastness of the image formed, employing the following criteria. The results are shown in Table 1.

Fusion:

○: the heat-transfer-recording image receiving sheet is smoothly peeled off from the heat-transfer-recording ink sheet.

X: the image receiving layer of the heat-transfer-recording image receiving sheet fuses with the heat-transfer-recording ink sheet and cannot be peeled off.

Transferred density (image preservability against heat):

The reflection density OD value was determined with an optical densitometer.

○: OD value is 2.0 or more.

Δ: OD value ranges from 1.7 to 2.0.

X: OD value is 1.7 or less.

Heat resistance:

Each image receiving sheet keeping the image record was preserved for 72 hours in an environment of 77 and 80% RH and then checked for bleeding out of dyes.

○: the dye image is not wore off easily when rubbed with the finger.

X: the dye image is easily wore off when rubbed with the finger.

Light fastness (image preservability against light):

Each image receiving sheet was kept in a weather meter for 72 hours and then visually checked for discoloration in the image.

○: little image discoloration

X: noticeable image discoloration

EXAMPLE 2

The same procedure as in Example 1 was repeated, except that a coating solution of the following composition was used to form an image receiving layer. The results are shown in Table 1.

| Coating solution to form the image receiving layer | |
|---|---|
| Vinyl chloride-type copolymer (MR-110 made by Nippon Zeon) | 8 parts |
| Polyester resin (Vylon 290 made by Toyobo., Tg: 73, MW: 20,000) | 2 parts |
| Polyester-modified silicone oil (X-24-8300 made by Shin-Etsu Silicone) | 0.25 part |
| Methyl ethyl ketone | 40 parts |
| Dioxane | 40 parts |
| Cyclohexanone | 20 parts |

EXAMPLE 3

The same procedure as in Example 1 was repeated, except that a coating solution of the following composition was used to form an image receiving layer. The results are shown in Table 1.

| Coating solution to form the image receiving layer | |
|---|---|
| Vinyl chloride-type copolymer (MR-120 made by Nippon Zeon) | 5 parts |
| Polyvinyl chloride (TK-300 made by Shin-Etsu Chemical) | 5 parts |
| Polyester-modified silicone oil (X-24-8300 made by Shin-Etsu Silicone) | 0.25 part |
| Methyl ethyl ketone | 40 parts |
| Toluene | 40 parts |
| Cyclohexanone | 20 parts |

EXAMPLE 4

The same procedure as in Example 1 was repeated, except that a coating solution of the following composition was used to form an image receiving layer. The results are shown in Table 1.

| Coating solution to form the image receiving layer | |
|---|---|
| Vinyl chloride-type copolymer (MR-120 made by Nippon Zeon) | 9 parts |
| Polycarbonate (L-1225LL made by Teijin Ltd.) | 1 part |
| Polyester-modified silicone oil (X-24-8310 made by Shin-Etsu Silicone) | 0.25 part |
| Tetrahydrofuran | 80 parts |
| Cyclohexanone | 20 parts |

EXAMPLE 5

The same procedure as in Example 1 was repeated, except that a coating solution of the following composition was used to form an image receiving layer. The results are shown in Table 1.

| Coating solution to form the image receiving layer | |
|---|---|
| Vinyl chloride-type copolymer (MR-110 made by Nippon Zeon) | 9.5 parts |
| Triphenyl phosphate (made by Daihachi Chemical) | 0.5 part |
| Polyester-modified silicone oil (X-24-8300 made by Shin-Etsu Silicone) | 0.25 part |
| Methyl ethyl ketone | 80 parts |
| Cyclohexanone | 20 parts |

EXAMPLE 6

The same procedure as in Example 1 was repeated, except that a coating solution of the following composition was used to form an image receiving layer. The results are shown in Table 1.

| Coating solution to form the image receiving layer | |
|---|---|
| Vinyl chloride-type copolymer (MR-110 made by Nippon Zeon) | 4.5 parts |
| Polyvinyl chloride (TK-600 made by Shin-Etsu Chemical) | 5.0 parts |
| Dioctyl phthalate (made by Daihachi Chemical) | 0.5 part |
| Polyester-modified silicone oil (X-24-8310 made by Shin-Etsu Silicone) | 0.25 part |
| Methyl ethyl ketone | 40 parts |
| Toluene | 40 parts |
| Cyclohexanone | 20 parts |

COMPARATIVE EXAMPLE 1

The same procedure as in Example 1 was repeated, except that a coating solution of the following composition was used to form an image receiving layer. The results are shown in Table 1.

| Coating solution to form the image receiving layer | |
|---|---|
| Polyester resin (Vylon 103 made by Toyobo Co.) | 10 parts |
| Epoxy-modified silicone (X-22-343 made by Shin-Etsu Chemical) | 0.125 part |
| Amino-modified silicone (KF-393 made by Shin-Etsu Chemical) | 0.125 part |
| Toluene | 40 parts |
| Methyl ethyl ketone | 40 parts |
| Cyclohexanone | 20 parts |

COMPARATIVE EXAMPLE 2

The same procedure as in Example 1 was repeated, except that a coating solution of the following composition was used to form an image receiving layer. The results are shown in Table 1.

| Coating solution to form the image receiving layer | |
|---|---|
| Polyvinyl chloride (TK-300 made by Shin-Etsu Chemical) | 10 parts |
| Polyester-modified silicone (X-24-8310 made by Shin-Etsu Silicone) | 0.125 part |
| Amino-modified silicone (KF-393 made by Shin-Etsu Chemical) | 0.125 part |
| Methyl ethyl ketone | 40 parts |
| Dioxane | 40 parts |
| Cyclohexanone | 20 parts |

TABLE 1

| | Fusion | Density | Heat resistance | Light fastness |
|---|---|---|---|---|
| Example 1 | ○ | ○ | ○ | ○ |
| Example 2 | ○ | ◎ | ○ | ○ |
| Example 3 | ○ | ○ | ○ | ○ |
| Example 4 | ○ | ○ | ○ | ○ |
| Example 5 | ○ | ◎ | ○ | ○ |
| Example 6 | ○ | ◎ | ○ | ○ |
| Comp. example 1 | ○ | Δ | ○ | X |
| Comp. example 2 | ○ | X | X | ○ |

What is claimed is:

1. A heat transfer recording sheet for thermal diffusion transfer recording comprising; (1) an ink sheet having a support, and an ink layer container a heat diffusible dye and a binder, and (2) an image receiving sheet comprising an image receiving layer containing a vinyl chloride resin having an epoxy group in its molecule.

2. An image receiving sheet according to claim 1, wherein the vinyl chloride resin contains a sulfonic group or carboxyl grouping the molecule.

3. An image receiving sheet according to claim 1, wherein the vinyl chloride resin contains a hydroxyl group in the molecule.

4. A heat transfer recording sheet for thermal diffusion transfer recording comprising; (1) an ink sheet having a support, and an ink layer containing a heat diffusible dye and a binder, and (2) an image receiving sheet comprising an image receiving layer containing a copolymer of the formula

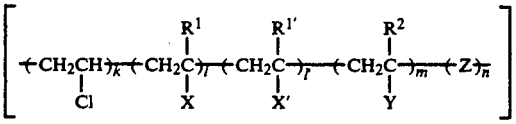

wherein $R^1$, $R^{1'}$ and $R^2$ independently are a hydrogen atom or a lower alkyl group; $R^1$, $R^{1'}$ and $R^2$ may be the same or different, X is —A—$SO_3M$; X' is —A'—COOM; and Y is

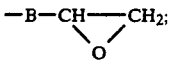

M is a hydrogen atom or an alkali metal atom;

k represents an integer of 200 to 800, 1 and 1' each represents an integer of 0 to 100 (provided that 1 and 1' are not zero concurrently), m an integer of 1 to 100, and n an integer of 0 to 200;

A, A' and B are independently an interlining group to join a —$SO_3M$, —COOM or epoxy group with the principal chain.

5. An image receiving sheet according to claim 4, wherein A, A' and B independently are

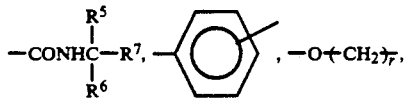

—COO$(CH_2)_r$, —CONH—, $(CH_2)_r$ or

—CONH$(CH_2)_r$, where $R^5$ and $R^6$ independently are a hydrogen atom, or an alkyl or phenyl group each having 1 to 15 carbon atoms; $R^7$ is an alkylene group having 1 to 15 carbon atoms; and r is an integer of 0 to 20.

6. An image receiving sheet according to claim 4, wherein Z is

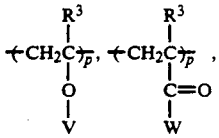

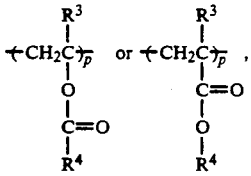

where $R^3$ is a hydrogen atom or a lower alyl group; V is a hydrogen atom or —$(CH_2)_q$—OH, or —$(CH_2CH_2O)_q$—H; W is —OM (m is a hydrogen or alkali metal atom), —$(OCH_2CH_2)_q$—OH, —$(OCH_2)_q$—OH (q=1 to 4); p is an integer of 1 to 50; and $R^4$ is an unsubstituted hydrocarbon having 1 to 20 carbon atoms.

7. An image receiving sheet according to claim 4, wherein the polymerization degree (Pn) of he copolymer is 250 to 500.

8. An image receiving sheet according to claim 4 wherein content of a repetitive unit having —$SO_3M$ or —COOM is 0 to 3 wt. %, a content of the repetitive unit having an epoxy group is 0.5 to 9 wt. %, and a content of vinyl chloride is 95 to 80 wt. %.

9. A process for obtaining thermal diffusion transfer images using an ink sheet and an image receiving sheet, said ink sheet having a support and an ink layer containing a heat diffusible dye and a binder, said image receiving sheet having an image receiving layer containing a copolymer of the formula

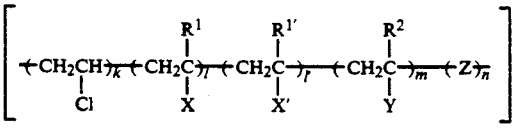

wherein $R^1$, $R^{1'}$ and $R^2$ independently are a hydrogen atom or a lower alkyl group; $R^1$, $R^{1'}$ and $R^2$ may be the same or different, X is —A—$SO_3M$; X' is —A'—COOM; and Y is

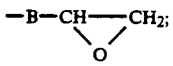

M is a hydrogen atom or an alkali metal atom;

k represents an integer of 200 to 800, 1 and 1' each represent an integer of 0 to 100 (provided that 1 and 1' are not zero concurrently), m an integer of 1 to 100, and n an integer of 0 to 200;

A, A' and B are independently an interlining group to join a —$SO_3M$, —COOM or epoxy group with the principal chain;

said processing comprising;

positioning said ink layer to be in contact with said image receiving sheet, and applying heat to said ink layer, thereby transferring said heat diffusible dye to said image receiving layer.

10. The process of claim 9 wherein A, A', and B are, independently;

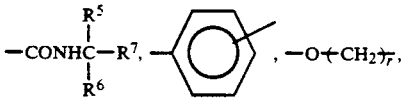

—COO$\leftarrow$CH$_2$$\rightarrow_r$, —CONH—, $\leftarrow$CH$_2$$\rightarrow_r$ or —CONH$\leftarrow$CH$_2$$\rightarrow_r$, where $R^5$ and $R^6$ independently are a hydrogen atom, or an alkyl or phenyl group each having 1 to 15 carbon atoms; $R^7$ is an alkylene group having 1 to 15 carbon atoms; and r is an integer of 0 to 20.

11. The process of claim 9 wherein Z is

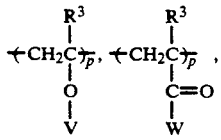

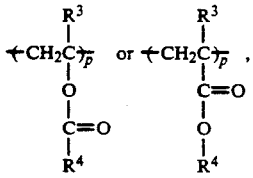

wherein $R^3$ is a hydrogen atom or a lower alyl group; V is a hydrogen atom or —$(CH_2)_q$—OH, or —$(CH_2CH_2O)_q$—H; W is —OM (M is a hydrogen or alkali metal atom), —$(OCH_2CH_2)_q$—OH, —$(OCH_2)_q$—OH (q=1 to 4); p is an integer of 1 to 50; and $R^4$ is an unsubstituted hydrocarbon having 1 to 20 carbon atoms.

12. The process of claim 9 wherein the degree of polymerization (Pn) of said copolymer is 250 to 500.

13. The process of claim 9 wherein a content of a repetitive group having —$SO_3M$ or —COOM is 0 to 3 wt. %, a content of a respective group having an epoxy group is 0.5 to 9 wt. %, and a content of vinyl chloride is 95 to 80 wt. %

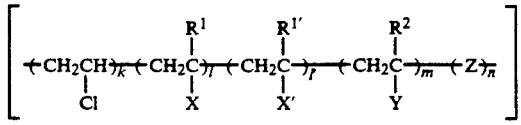

wherein $R^1$, $R^{1'}$ and $R^2$ independently are a hydrogen atom or a lower alkyl group; $R^1$, $R^{1'}$ and $R^2$ may be the same or different, X is —A—$SO_3M$; X' is —A'—COOM; and Y is

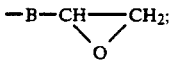

M is a hydrogen atom or an alkali metal atom;

k represents an integer of 200 to 800, 1 and 1' each represent an integer of 0 to 100 (provided that 1 and 1' are not zero concurrently), m an integer of 1 to 100, and n an integer of 0 to 200, A, A' and B are independently

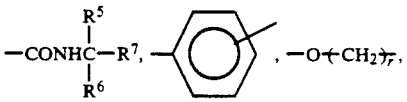

—COO$\leftarrow$CH$_2$$\rightarrow_r$, —CONH—, $\leftarrow$CH$_2$$\rightarrow_r$ or —CONH$\leftarrow$CH$_2$$\rightarrow_r$, where $R^5$ and $R^6$ independently are a hydrogen atom, or an alkyl or phenyl group each having 1 to 15 carbon atoms; $R^7$ is an alkylene group having 1 to 15 carbon atoms; and r is an integer of 0 to 20, Z is

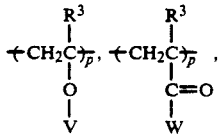

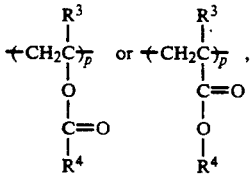

14. A heat transfer recording sheet for thermal diffusion transfer recording comprising; (1) an ink sheet having a support, and an ink layer containing a heat diffusible dye and a binder, and (2) an image receiving sheet comprising an image receiving layer containing a copolymer of the formula where $R^3$ is a hydrogen atom or a lower alyl group; V is a hydrogen atom or $-(CH_2)_q-OH$, or $-(CH_2CH_2O)_q-H$; W is —OM (M is a hydrogen or alkali metal atom), $-(OCH_2CH_2)_q-OH$, $-(OCH_2)_q-OH$ (q=1 to 4); p is an integer of 1 to 50; and $R^4$ is an unsubstituted hydrocarbon having 1 to 20 carbon atoms.

15. A process for obtaining thermal diffusion transfer images using an ink sheet a an image receiving sheet, said ink sheet having a support and an ink layer containing a heat diffusible dye, and a binder, said image receiving sheet having an image receiving layer containing a copolymer of the formula

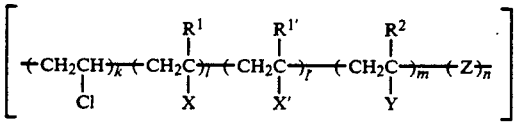

wherein $R^1$, $R^{1'}$ and $R^2$ independently are a hydrogen atom or a lower alkyl group; $R^1$, $R^{1'}$ and $R^2$ may be the same or different, X is $-A-SO_3M$; X' is $-A'-COOM$; and Y is

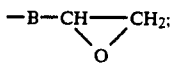

M is a hydrogen atom or an alkali metal atom;

k represents an integer of 200 to 800 ,1 and 1' each represent an integer of 0 to 100 (provided that 1 and 1' are not zero concurrently), m an integer of 1 to 100, and n an integer of 0 to 200;

A' and B are independently

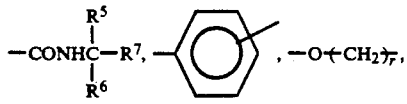

$-COO(CH_2)_r-$, $-CONH-$, $(CH_2)_r$ or $-CONH(CH_2)_r-$, where $R^5$ and $R^6$ independently are a hydrogen atom, or a alkyl or phenyl group each having 1 to 15 carbon atoms; $R^7$ is an alkylene group having 1 to 15 carbon atoms; and r is an integer of 0 to 20, Z is

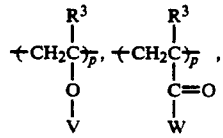

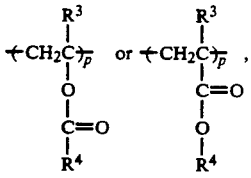

wherein $R^3$ is a hydrogen atom or a lower alyl group; V is a hydrogen atom or $-(CH_2)_q-OH$, or $-(CH_2CH_2O)_q-H$; W is —OM (M is a hydrogen or alkali metal atom), $-(OCH_2CH_2)_q-OH$, $-(OCH_2)_q-OH$ (q=1 to 4); p is an integer of 1 to 50; and $R^4$ is an unsubstituted hydrocarbon having 1 to 20 carbon atoms, said process comprising;

positioning said ink layer to be in contact with said image receiving sheet, and applying heat to said ink layer, thereby transferring said heat diffusible dye to said image receiving layer.

* * * * *

UNITED STATES PATENT AND TRADEMARK OFFICE

CERTIFICATE OF CORRECTION

PATENT NO. : 5,270,283

DATED : December 14, 1993

INVENTOR(S) : KOSHIZUKA, et al

It is certified that error appears in the above-identified patent and that said Letters Patent is hereby corrected as shown below:

On title page, add the following:

[30] Foreign Application priority data
September 12, 1991
Japan --- No. 243265/1990

Signed and Sealed this

Tenth Day of January, 1995

*Attest:*

*Attesting Officer*

BRUCE LEHMAN

*Commissioner of Patents and Trademarks*